US005155967A

United States Patent [19]

Branson

[11] Patent Number: 5,155,967

[45] Date of Patent: Oct. 20, 1992

[54] AUTOMATED BAG MANUFACTURING AND PACKAGING SYSTEM

[75] Inventor: Mark E. Branson, Shelbyville, Ind.

[73] Assignee: KCL Corporation, Shelbyville, Ind.

[21] Appl. No.: 709,616

[22] Filed: Jun. 3, 1991

[51] Int. Cl.[5] ..... B65B 5/10; B65B 35/56; B65H 29/34

[52] U.S. Cl. ..... 53/55; 53/144; 53/244; 53/540; 493/204; 493/211; 493/215

[58] Field of Search ..... 53/55, 268, 244, 475, 53/544, 540, 543, 534, 144, 143; 493/204, 211, 215; 83/86; 414/788.2, 788.3, 791.2

[56] References Cited

U.S. PATENT DOCUMENTS

| | | | |
|---|---|---|---|
| 2,659,187 | 11/1953 | Barnes | 53/143 X |
| 3,766,701 | 10/1973 | Besserdich et al. | 53/540 X |
| 4,045,941 | 9/1977 | Flantua | 53/244 X |
| 4,183,704 | 1/1980 | Steinhart | 414/788.3 |
| 4,435,944 | 3/1984 | Meyer | 53/244 X |
| 4,451,249 | 5/1984 | deBin | 493/204 |

FOREIGN PATENT DOCUMENTS

| | | | |
|---|---|---|---|
| 650490 | 10/1962 | Canada | 493/204 |

*Primary Examiner*—James F. Coan
*Attorney, Agent, or Firm*—Woodard, Emhardt, Naughton, Moriarty & McNett

[57] ABSTRACT

An apparatus for the continuous packaging of flexible bags is adapted for use with a continuous bag manufacturing machine. Separate bags are received on a conveyor which conveys the bags to a stacking station at the end of the conveyor. At the stacking station, the bags are stacked in a catch tray until a predetermined number of bags have been collected, at which point the tray is opened to drop the bags into an open container supported on a turntable beneath the catch tray. The turntable is rotatable to convey the open container away from the stacking station to an unloading station when the container has been filled with bags. The turntable rotatably supports a number of support plates evenly distributed around the perimeter of the turntable, upon which an open container sits. A multi-motion actuator situated at the stacking station underneath the turntable is operable to rotate the support plate at the stacking station relative to the turntable. Rotation of the support plate rotates the container supported by the plate, thereby providing means for alternating the orientation of bags stacked within the container to optimally accommodate the greater bag thickness at the zipper profile end of the bags. The actuator can be disengaged from the support plate to permit rotation of the turntable as the filled container is discharged from the turntable and as a new empty container is moved to the stacking station.

34 Claims, 10 Drawing Sheets

Fig. 11A

| Address | Instruction | Data | Descriptions |
|---|---|---|---|
| 0000 | STR | 000 | ENABLE |
| 0001 | AND NOT | 001 | AUTO MODE 1SS-A |
| 0002 | AND | 002 | MANUAL MODE 1SS-B |
| 0003 | OUT | 200 | MANUAL MODE |
| 0004 | STR | 003 | START 2 PB |
| 0005 | OR | 201 | RUN MODE |
| 0006 | AND | 000 | ENABLE |
| 0007 | AND | 001 | AUTO MODE 1SS-A |
| 0010 | AND NOT | 002 | MANUAL MODE 1SS-B |
| 0011 | AND | 004 | STOP CYCLE 3 PB |
| 0012 | OUT | 201 | RUN MODE |
| 0013 | STR | 173 | COUNT L.S. DETECTED |
| 0014 | STR | 200 | MANUAL MODE |
| 0015 | AND | 010 | MANUAL COUNT 2 SS |
| 0016 | OR STR | | |
| 0017 | OUT | 114 | CYCLE COUNT MAC VALVE #5 |
| 0020 | STR | TMR 03 | ROTATE TABLE TIMER-START |
| 0021 | AND NOT | TMR 04 | ROTATE TABLE TIMER-END |
| 0022 | STR | 200 | MANUAL MODE |
| 0023 | AND | 011 | MANUAL ROTATE 3 SS |
| 0024 | OR STR | | |
| 0025 | OUT | 113 | ROTATE TABLE MAC VALVE #4 |
| 0026 | STR | TMR 06 | HOPPER RELEAS TIMER-START |
| 0027 | AND NOT | TMR 07 | HOPPER RELEAS TIMER-END |
| 0030 | STR | 200 | MANUAL MODE |
| 0031 | AND | 012 | MANUAL HOPPER 4 SS |
| 0032 | OR STR | | |

| Address | Instruction | Data | Descriptions |
|---|---|---|---|
| 0033 | OUT | 110 | HOPPER RELEAS MAC VALVE #1 |
| 0034 | STR | TMR 10 | M-M EXTEND TIMER-START |
| 0035 | AND NOT | TMR 11 | M-M EXTEND TIMER-END |
| 0036 | STR | 200 | MANUAL MODE |
| 0037 | AND | 013 | MANUAL MM ROT EXT 5 SS |
| 0040 | OR STR | | |
| 0041 | OUT | 111 | M-M EXTEND MAC VALVE #2 |
| 0042 | STR | TMR 12 | M-M ROTATE TIMER-START |
| 0043 | AND NOT | TMR 13 | M-M ROTATE TIMER-END |
| 0044 | STR | 200 | MANUAL MODE |
| 0045 | AND | 014 | MANUAL MM ROT 6 SS |
| 0046 | OR STR | | |
| 0047 | OUT | 112 | M-M ROTATE MAC VALVE #3 |
| 0050 | STR | 201 | RUN MODE |
| 0051 | AND | CNT 05 | BAG COUNTER GROUP=50 |
| 0052 | STR NOT | 201 | RUN MODE |
| 0053 | OR | 172 | CYCLE COMPLT |
| 0054 | CNT | 14 | BAG TOTALIZER COUNT=1000 |
| 0055 | PRESET | 0020 | |
| 0056 | STR | 201 | RUN MODE |
| 0057 | AND NOT | 172 | CYCLE COMPLT |
| 0060 | TMR | 03 | ROTATE TABLE TIMER-START |
| 0061 | PRESET | 0090 | |
| 0062 | STR | 201 | RUN MODE |
| 0063 | AND NOT | 172 | CYCLE COMPLT |
| 0064 | TMR | 04 | ROTATE TABLE TIMER-END |
| 0065 | PRESET | 0140 | |

Fig. 11B

| Address | Instruction | Data | Descriptions |
|---|---|---|---|
| 0066 | STR | 201 | RUN MODE |
| 0067 | AND | 015 | BAG COUNT IN 1 LS |
| 0070 | STR NOT | 201 | RUN MODE |
| 0071 | STR | 170 | DO HOPPER,M-M SEQUENCE |
| 0072 | F-44 | | |
| 0073 | OR STR | | |
| 0074 | CNT | 05 | BAG COUNTER GROUP=50 |
| 0075 | PRESET | 0050 | |
| 0076 | STR | CNT 05 | BAG COUNTER GROUP=50 |
| 0077 | OR | 170 | DO HOPPER,M-M SEQUENCE |
| 0100 | AND NOT | 171 | HOPPER M-M SEQ COMPLETE |
| 0101 | AND | 201 | RUN MODE |
| 0102 | OUT | 170 | DO HOPPER,M-M SEQUENCE |
| 0103 | STR | 170 | DO HOPPER,M-M SEQUENCE |
| 0104 | TMR | 06 | HOPPER RELEAS TIMER-START |
| 0105 | PRESET | 0020 | |
| 0106 | STR | 170 | DO HOPPER,M-M SEQUENCE |
| 0107 | TMR | 07 | HOPPER RELEAS TIMER-END |
| 0110 | PRESET | 0040 | |
| 0111 | STR | 170 | DO HOPPER,M-M SEQUENCE |
| 0112 | AND NOT | CNT 14 | BAG TOTALIZER COUNT=1000 |
| 0113 | TMR | 10 | M-M EXTEND TIMER-START |
| 0114 | PRESET | 0001 | |
| 0115 | STR | 170 | DO HOPPER,M-M SEQUENCE |
| 0116 | AND NOT | CNT 14 | BAG TOTALIZER COUNT=1000 |
| 0117 | TMR | 11 | M-M EXTEND TIMER-END |
| 0120 | PRESET | 0060 | |
| 0121 | STR | 170 | DO HOPPER,M-M SEQUENCE |
| 0122 | AND NOT | CNT 14 | BAG TOTALIZER COUNT=1000 |
| 0123 | TMR | 12 | M-M ROTATE TIMER-START |
| 0124 | PRESET | 0030 | |
| 0125 | STR | 170 | DO HOPPER,M-M SEQUENCE |
| 0126 | AND NOT | CNT 14 | BAG TOTALIZER COUNT=1000 |
| 0127 | TMR | 13 | M-M ROTATE TIMER-END |
| 0130 | PRESET | 0070 | |
| 0131 | STR | TMR 07 | HOPPER RELEAS TIMER-END |
| 0132 | AND | CNT14 | BAG TOTALIZER COUNT=1000 |
| 0133 | OR | TMR11 | M-M EXTEND TIMER-END |
| 0134 | OUT | 171 | HOPPER M-M SEQ COMPLETE |
| 0135 | STR | 171 | HOPPER M-M SEQ COMPLETE |
| 0136 | AND | CNT 14 | BAG TOTALIZER COUNT=1000 |
| 0137 | OUT | 172 | CYCLE COMPLT |
| 0140 | STR | 015 | BAG COUNT IN 1 LS |
| 0141 | AND | 201 | RUN MODE |
| 0142 | OUT | 173 | COUNT L.S. DETECTED |
| 0143 | NOP | 173 | COUNT L.S. DETECTED |

AUTOMATED BAG MANUFACTURING AND PACKAGING SYSTEM

BACKGROUND OF THE INVENTION

The present invention concerns a system for automatically manufacturing reclosable flexible bags of the type having reclosable interlocking zipper profiles. More particularly, the invention concerns a system that continuously and automatically produces individual bags and packages the bags in a shipping container or box.

In the manufacture of reclosable flexible bags, the bags are usually formed from an extruded sheet of plastic film. Flexible interlocking zipper profiles can be formed inside the top edges of the bag, such as described in U.S. Pat. No. Re. 28,959 to Naito. Alternatively, the zipper profiles can be separately extruded and then sealed adjacent the top edges of the bag. In some applications, the fastener profiles are continuously sealed on the inside surface of the bag. In other applications, such as that described in the patent to Branson, U.S. Pat. No. 4,787,755, the fastener profiles are sealed at their ends to the side edges of the bag.

One typical bag manufacturing process and apparatus is shown and described in U.S. Pat. No. 4,787,755. In this process, a roll of plastic film is provided to the manufacturing apparatus and is advanced through the several stages by commonly known powered rollers. While the process and apparatus of the Branson patent shows the simultaneous production of pairs of bags, a similar process can be employed in the manufacture of single bags having fastener profiles adjacent their top openings.

It is common in most bag manufacturing processes that the finished bags are directed to a loading table where the bags are manually loaded into shipping containers or boxes. This manual loading technique results in high labor costs since human intervention is required. In addition, the manual loading technique can reduce the speed of bag production since the speed of the manual loading is typically one of the limiting features of bag processing and packaging speed.

One aspect of packaging the newly produced reclosable bags that decreases the manual loading time is that the bags should optimally be packed in alternating opposing relation. The zipper profiles increase the thickness of the bag adjacent the top of the bag so that if the bags are stacked in the same orientation, fewer bags can be packed into a given shipping container. Thus, in order to increase the bag count within a shipping container, it is preferable that the bags be alternatingly arranged so that the zipper profiles between consecutive groups of bags are at different orientations.

There is a need in the industry for an automatic bag manufacturing and packaging machine that can eliminate the need for human intervention as much as possible from start to finish in the production and packaging process. There is also a need for a machine that can optimally package reclosable bags into a shipping box so that the greatest number of bags can be stacked within the container.

SUMMARY OF THE INVENTION

In one embodiment, of the invention, a system for the continuous manufacture of reclosable flexible bags includes an extruder for extruding a continuous sheet of film with means for providing interlocking zipper profiles on the sheet. The sheet is continuously drawn from the extruder with the interlocking zipper profiles oriented in opposing relation. An edge sealer intermittently seals the sheet to form sealed bag edges and then cuts the sheet into separate bags at the sealed edges. The separate bags are carried by a conveyor to a stacking station which includes means for supporting an open container. The separate bags are collected in a catch tray which is opened after a predetermined number of bags have been collected, to drop the stack of bags into the open container.

The means for supporting the container includes a turntable having a number of rotatably mounted support plates upon which the open container rest. Means are provided for rotating the turntable so that a filled container can be moved to a discharge station and a new empty container moved to the stacking station. In one embodiment, each of the support plates includes a spindle projecting through a bore in the turntable and connected to a base plate beneath the turntable. A multi-motion actuator is situated at the stacking station having a rotator plate that is moved into contact with the base plate and rotated to rotate the base plate and thereby the support plate. A programmable controller provides control signals to the multi-motion actuator to rotate the container to provide alternating orientations of the stacks of bags within the container.

BRIEF DESCRIPTION OF THE DRAWINGS

FIGS. 11A-11B show an example of a program implementing the steps of the flowchart in FIG. 7 in a programmable controller of one specific embodiment of the invention.

DESCRIPTION OF THE PREFERRED EMBODIMENT

Figures 1A, 1B:
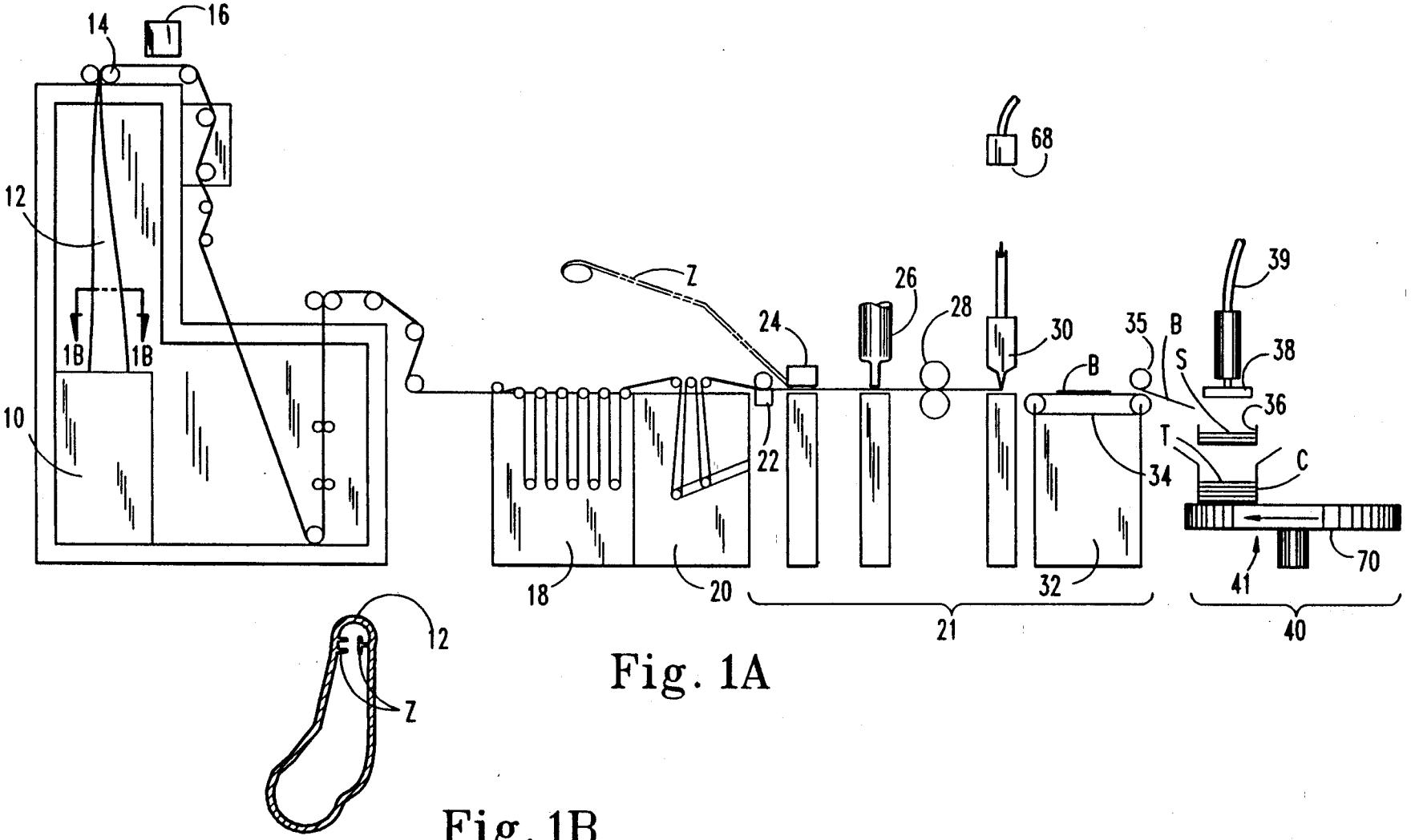
FIG. 1A is a schematic pictorial representation of one embodiment of the automatic bag manufacturing and packaging system of the present invention.
FIG. 1B is an enlarged cross-sectional view of a flexible bag extruded in the automatic system shown in FIG. 1A.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 is a schematic pictorial representation of the basic components of the automatic bag manufacturing and packaging system of the present invention. A film extruder 10 produces extruded tubing 12, which can be a thin plastic film having zippers extruded in opposing relation. In the present embodiment, the extruded zippered tubing 12 has the configuration shown in FIG. 1B in which a pair of opposing interlocking and zipper profiles Z are adjacent one end of the tubing 12. The extruded tubing 12 is drawn from the extruder by way of a primary nip drive 14 at the top of the extruder apparatus. A tachometer 16 controls the speed of the nip drive 14 to control the rate of extrusion of the tubing 12 from the extruder 10. In one specific embodiment, the extruder can be a known commercially available extruding apparatus, such as a conventional blown film extruder. The extruded tubing 12 passes through a number of rollers during its processing within the apparatus and ultimately is directed to a standard commercially available accumulator 18 and tensioner 20 which maintain appropriate tension on the tubing 12 as it passes from the extruder to the consecutive bag forming stations.

The bag forming stations are part of the means for forming separate bags generally designated as means 21 in FIG. 1A. This means for forming separate bags 21 first includes an edge knife 22 which is used to produce the bag opening adjacent the zippers Z of the extruded tubing 12 by cutting the tubing open to form opposite sheets of film. The opposite sheets of film having the zippers Z integrally formed thereon pass through a zipper guide 24 which aligns the opposing interlocking zippers. The zipper guide 24 can also automatically interlock the profiles in one specific embodiment. It is understood that alternatively, the extruded tubing 12 can simply be a continuous cylindrical tubing form without the zipper profiles Z integrally formed therein. Zipper profiles Z', as shown in phantom lines in FIG. 1A, can be separately provided and guided into adjacent relationship with the tubing film by way of the zipper guide 24. In this instance, an ultrasonic sealer 26 can be provided to intermittently seal the zipper profile Z' at its ends to what will become the edges of the finished bag in subsequent stations. This manner of attaching zipper profiles Z' is more clearly shown and described in the Branson U.S. Pat. No. 4,787,755, and particularly in FIG. 4 of that reference along with its accompanying description, which description is specifically incorporated herein by reference.

A pair of powered draw rollers 28 intermittently draw the zippered tubing 12 through the edge knife 22, zipper guide 24 and ultrasonic sealer 26 (where appropriate). It is understood that the tensioner 20 permits the tubing 12 to negotiate the transition from the continuous feed rate from the extruder 10 to the intermittent rate at which the tubing is drawn by the powered draw rollers 28 through the sealing stations. The bag forming means 21 also includes a side sealing bar 30 which seals opposite sheets of the tubing 12 together to form sealed side edges of the bag. The side sealing bar 30 can of conventional construction to automatically seal and cuts the side edges to produce separate bags as the tubing exits the sealing bar station 30 as described more fully in Branson U.S. Pat. No. 4,787,755. A conveyor apparatus 32 automatically conveys the separate bags B to a discharge belt 34. A pair of guide rollers 35 push the finished bag B off the discharge belt 34 into the adjacent packaging assembly.

At the packaging assembly 40 the separate bags B are automatically packaged within a shipping container or box C at a stacking station 41. The finished bags are collected in a catch tray 36 as they fall from the discharge belt 34 into the tray. A number of bags are collected in the tray assembly 36 to form a stack S containing a predetermined number of bags. After the predetermined number of bags has been reached, the catch tray assembly 36 opens to permit the stack S to fall into the shipping container C onto a stack T which may have previously been stored within the container. In one embodiment, a pneumatically operated stack compressor 38 extends a foot 38*a* as each new bag B drops into the catch tray to compress each stack S forming in the tray prior to being dropped into the shipping container C. The pneumatic stacking compressor 38 acts to squeeze the air trapped within the bags B in each of the stacks to permit a greater quantity of bags to be collected within the shipping container C. In the preferred embodiment, the stroke of the foot 38*a* is a fixed distance to compress the stack S to a specific height. In operation, the first few bags falling into the catch tray will not be contacted by the foot 38*a* dues to the fixed stroke of the stack compressor 38.

Figure 2:
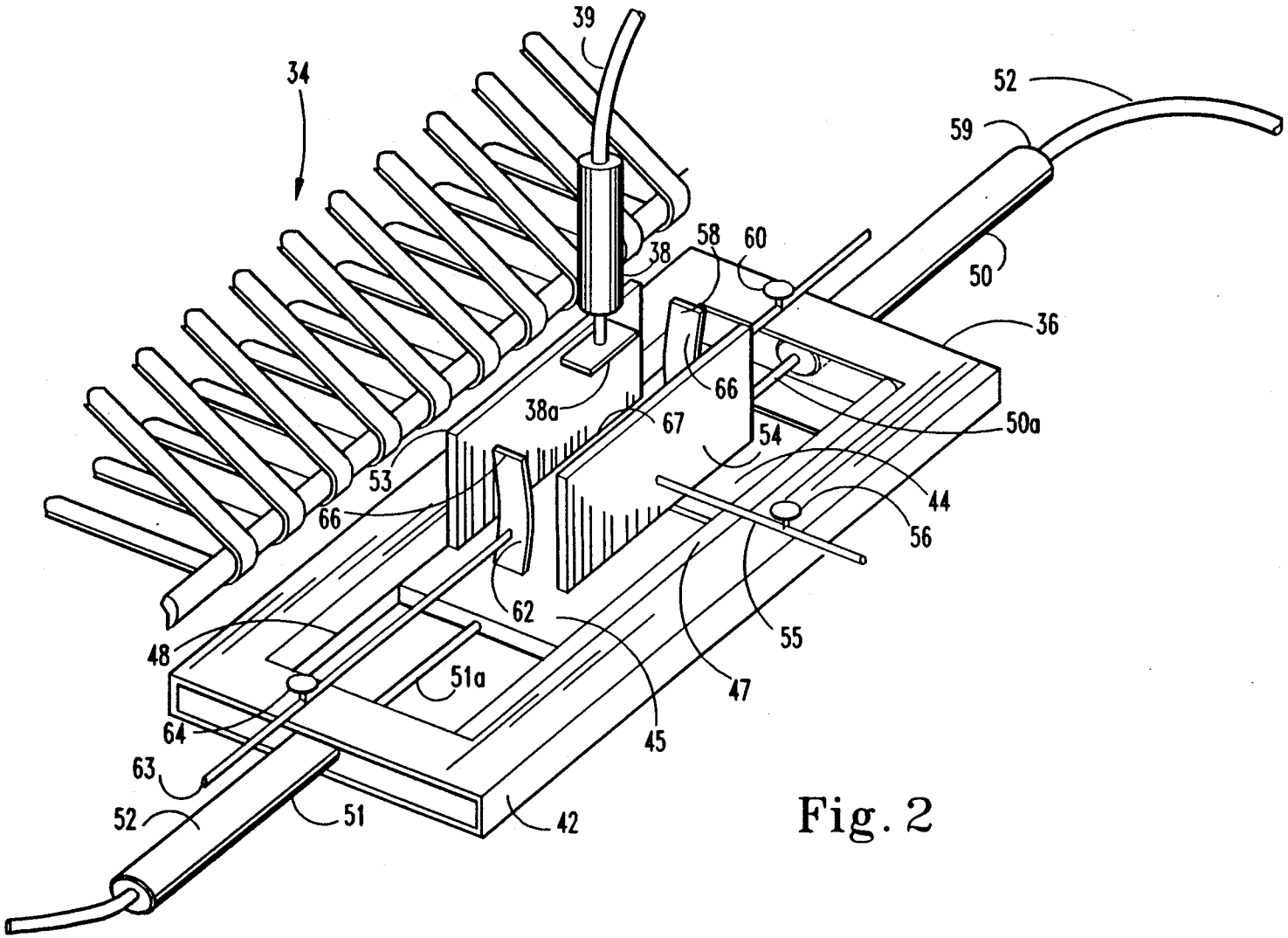
FIG. 2 is an enlarged detailed top perspective view of the catch-tray assembly of the system shown in FIG. 1.

The details of the catch tray assembly 36 are shown in the enlarged top perspective view of FIG. 2. The catch tray assembly 36 includes a frame 42 which supports the various components of the tray. The assembly further includes a right door 44 and a left door 45 which are slidably disposed within opposite slide channels 47 and 48. In the preferred embodiment, the left and right doors 44 and 45, respectively, are constructed from metal sheets, such as stainless steel, having a thickness of approximately 1/8 inch. The forward and rear slide channels 47 and 48, respectively, are preferably U-shaped or grooved nylon beams so that the left and right doors 44 and 45 can slide together and apart longitudinally. The doors 44 and 45 are connected to right and left actuators 50 and 51, respectively. The actuators 50 and 51 are mounted on the frame 42 and are connected to their respective door by way of an actuator rod 50*a* or 51*a*. Each of the actuators 50 and 51 are pneumatically operated so that a pneumatic hose 52 extends from the actuator body.

The catch tray assembly 36 further includes a number of support walls which serve to align the bags B into individual stacks S (FIG. 1A). For instance, a rear stacking support wall 53 and opposite forward support wall 54 provide forward and rearward alignment for the bags B as they fall from discharge belt 34. The rear stacking support wall 53 is preferably fixed to the frame 42 and is aligned directly beneath the end of the discharge belt 34. The forward stacking support wall 54 is connected to the frame 42 by way of an adjustment rod 55 and fixture 56. The fixture 56 permits slidable adjustment of the rod 55 relative to the frame 42 to account for variations in dimensions of bags processed by the system. Thus, for larger bags, the forward stacking support wall 54 can be moved away from the rear stacking support wall 53 to accommodate the larger bag B.

Side alignment is provided by a right side support wall 58 and a left side support wall 52. The right side wall 58 is attached to the frame 42 by way of an adjustment rod 59 and fixture 60, while the left wall 62 is connected by way of an adjustment rod 63 and fixture 64. The right and left support walls 58 and 62, respectively, can be adjusted for various bag dimensions in the same manner that the forward stacking support wall 54 is adjusted. Each of the side support walls 58 and 62 includes a curved guide surface 66 which corrects any misalignment of the bag B as it falls from the discharge belt 34 into the catch tray assembly 36. The curved guide surfaces 66 direct the bag into the stacking space 67 between the rear and forward support walls 53 and 54.

In the operation of the catch tray assembly 36, bags dropped from the discharge belt 34 are guided by the rear and forward support walls 53 and 54 and the right and left side support walls 58 and 62 onto the surface of the right and left doors 44 and 45, respectively, of the catch tray assembly. It should be apparent that the orientation of the support walls relative to the junction between the right and left doors depends upon the dimensions of the bag being supported by the catch tray assembly. Thus, a larger bag would occupy a larger area of the right and left doors 44 and 45.

A counter 68, such as a micro-switch, at the side sealing bar station 26 can be used to send a signal as each new bag B is formed. This signal is fed to a programmable controller 100 (FIG. 4) which counts the number of bags produced, and more particularly the number of bags in a stack S within the catch tray assembly 36. When a predetermined number of bags have been stacked on the right and left doors 44 and 45, the actuators 50 and 51 are energized to pull the doors apart. As the doors 44 and 45 are drawn apart, the stack of bags S drops into the container C waiting beneath the catch tray assembly (see FIG. 3). Preferably the right and left doors 44 and 45 are moved substantially simultaneously and the stack S is centered over the junction between the doors. In the preferred configuration shown in FIG. 2, approximately a one inch gap at the junction between the two doors is provided so that the stack S of bags sags slightly before the doors are opened. This initial sag in the stack S has been found to allow the bags to drop more uniformly into the open container C.

In one embodiment of the invention, the stacks S being discharged into a container C may be accumulated in the same orientation within the container. Once the container C is full, the container can be withdrawn from the stacking station, either manually or mechanically by way of a conveyor. Using the signal from the counter 68 the programmable controller 100 can count the total number of bags being dropped into each container so that once a predetermined number of bags has been reached, the container is withdrawn.

Figure 3:
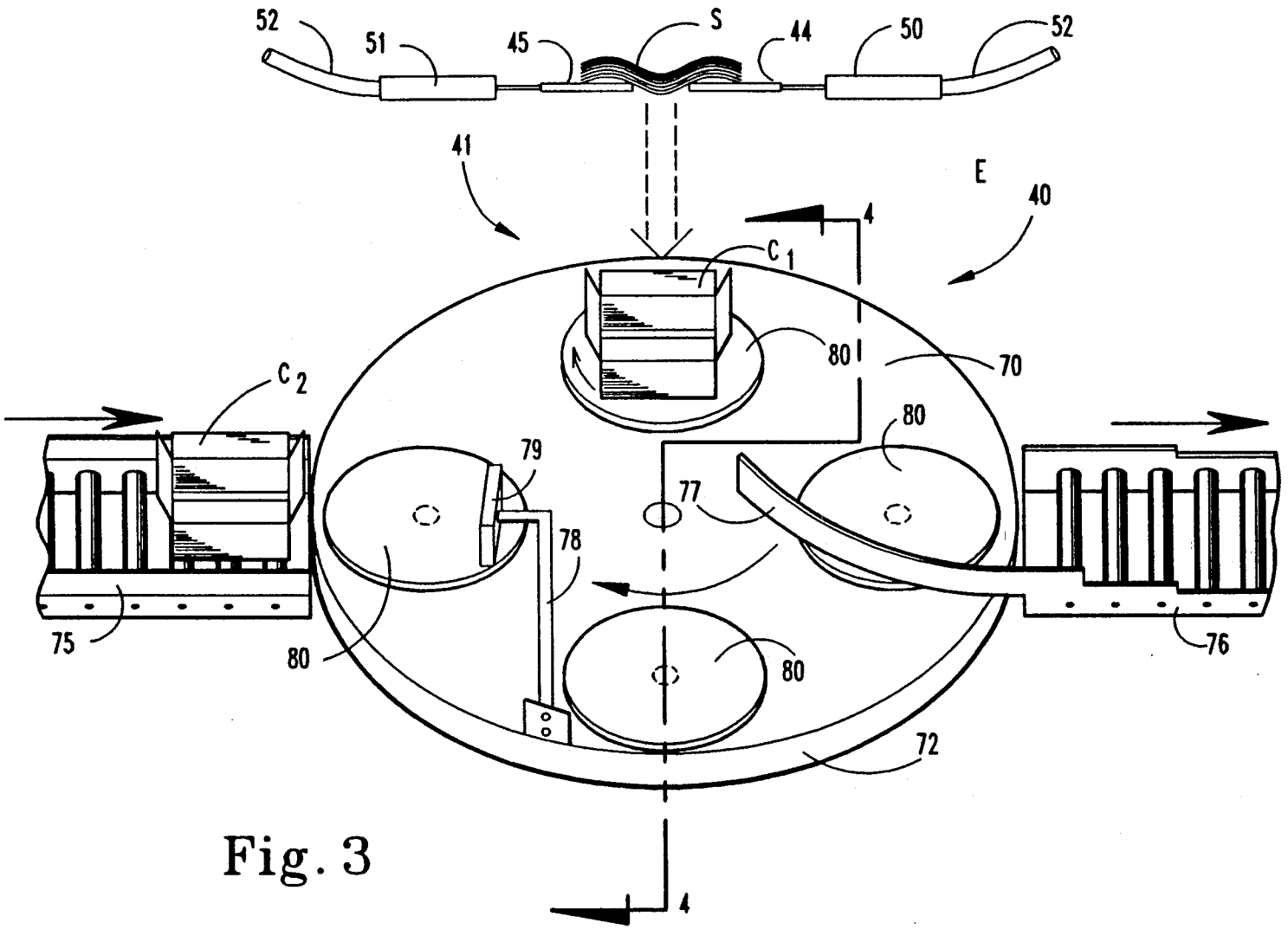
FIG. 3 is a top perspective view of one embodiment of this packaging station for use in the automatic bag manufacturing and packaging system shown in FIG. 1.

However, when it is important to fill the container C with as many bags as possible, it is necessary to alternate the orientation of the stacks of bags so that the zipper profiles Z are not always arranged in the same orientation, thereby increasing the overall effective thickness of each stack S. In the preferred embodiment of the invention, the packaging assembly includes a turntable 70 supported within a frame 72, as shown in FIG. 3. Each new opened container C is conveyed by rotation of the turntable 70 to a location directly beneath the catch tray assembly 36, that is at the stacking station. In addition, further rotation of the turntable 70 after a given container is filled can be used to convey the filled container away from beneath the catch tray assembly 36, thereby permitting a new empty container to be moved into its place. A feed conveyor 75 perpendicularly intersects the turntable 70 to provide new containers, such as container $C_2$, onto the turntable 70. An adjustable arm 78 supports a stop plate 79 which stops the inward motion of a new container $C_2$ at an appropriate radial location on the perimeter of the turntable 70 so that as the turntable rotates the container $C_2$ will be directly beneath the catch tray assembly.

In the preferred embodiment, an unloading conveyor 76 is positioned diametrically opposite the feed conveyor 75. An unloading arm 77 projects from the conveyor 76 over the surface of the turntable 70. The unloading arm 77 is curved so that containers rotating with the turntable 70 are urged off the turntable onto the unloading conveyor 76. It is apparent that the feed conveyor 75 and the unloading conveyor 76 provide a means for continuously supplying new empty containers $C_2$ to the stacking station 40 and removing filled containers $C_1$ from the stacking station for closing and shipping.

In one embodiment, a number of rotator plates 80 are mounted on the turntable 70 at uniformly dispersed locations around the perimeter of the turntable. Each new container $C_2$ is directed onto a given rotator plate 80 and remains on that plate as the turntable 70 is rotated, at least until the container is directed off the turntable by the unloading arm 77. The stop plate 79 ensures that the container is properly oriented on the plate 80. The rotator plate 80 provides means for supporting the open container, as well as means for rotating the container through a predetermined number of angular degrees when the container is at the stacking station 41. Rotation of the rotator plate 80 is controlled to provide a predetermined series of alternating orientations of the stacks S being dropped into the container $C_1$, as will be described more fully herein.

Figure 4:
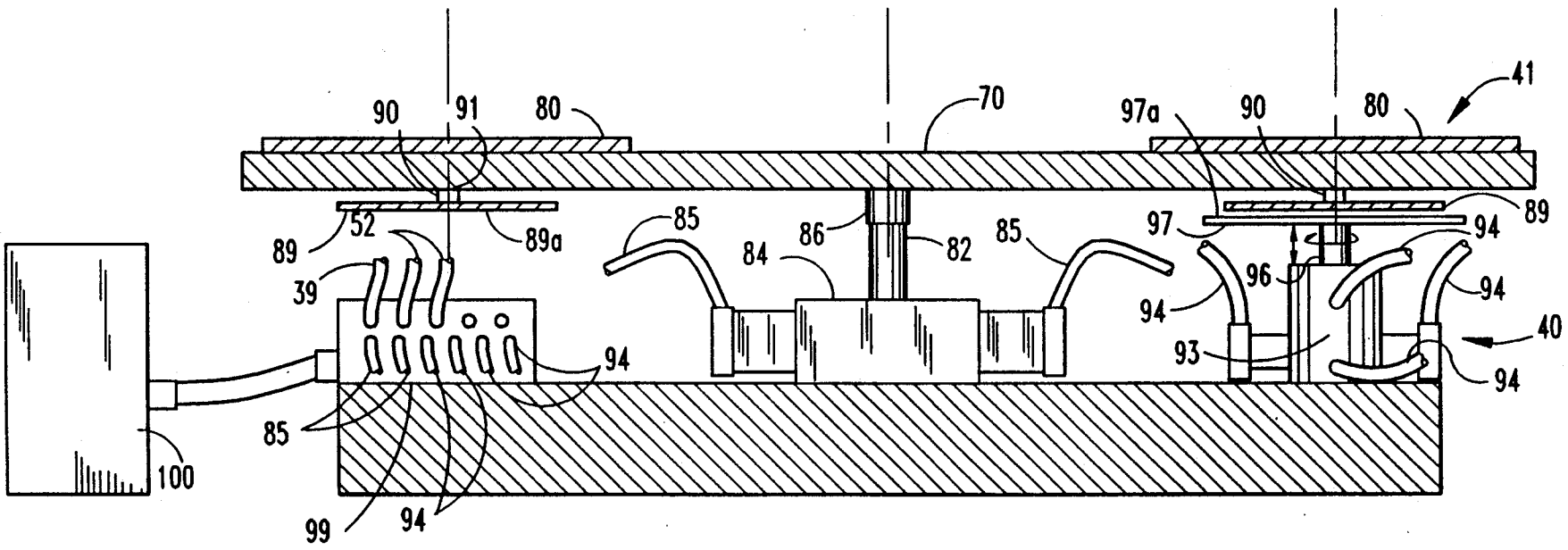
FIG. 4 is a side cross-sectional view of the packaging assembly of FIG. 3 taken along line 4—4 as viewed in the direction of the arrows.

Referring to FIG. 4, rotation of the turntable 70 is accomplished by an axle 82 which projects from a rotary actuator 84. In the preferred embodiment, the actuator 84 is pneumatic and is fed by a pair of pneumatic hoses 85. In one specific embodiment, the rotary actuator 84 is manufactured by phd, Inc. of Fort Wayne, Ind. under catalog number 913F. A one-way clutch 86 between the axle 82 and the turntable 70 permits the actuator 84 to return to its initial condition after each rotation of the turntable 70. The stroke of the actuator 84 can be calibrated to produce a specific predetermined angular rotation of the turntable 70. For instance, in the embodiment shown in FIG. 3 in which rotator plates 80 are disposed at 90° intervals around the turntable, the actuator 84 can be calibrated to rotate the turntable 70 at precise 90° increments. On the other hand, alternative arrangements of the rotator plates 80 on the turntable 70 can be utilized. For instance, the plates can be located at 120° intervals, in which case the rotary actuator 84 would be calibrated to rotate the turntable 70 through 120° increments.

Figure 5:
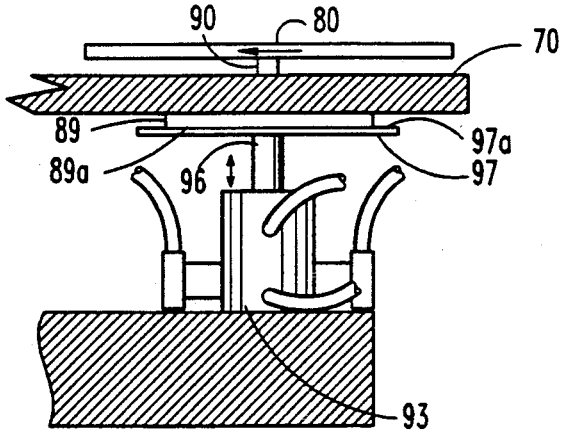
FIG. 5 is an enlarged view of one of the rotator plates at the stacking station of the packaging assembly shown in FIG. 4.

Referring now to FIGS. 4 and 5, the construction of the rotator plate 80 and the means for rotating the plate are illustrated. Each rotator plate 80 is situated on the upper face of the turntable 70 and includes a base plate 89 which is suspended beneath the rotator plate 80 by way of a mounting spindle 90. The mounting spindle 90 passes through a bore 91 in the turntable 70. The spindle 90 can be formed of a soft metal to permit smooth rotation of the spindle 90 within the bore 91 of the turntable. Preferably, the spindle 90 is threaded at one end to be engaged with a comparable threaded bore in the rotator plate 80 or base plate 89, in order to facilitate assembly and repair. In one embodiment, the base plate 89 includes a friction surface $89_a$ at its downwardly exposed face. Beneath the base plate 89 at the stacking station 41 is a multi-motion actuator 93. The actuator 93 is pneumatically controlled and includes a number of pneumatic hoses 94 providing air or other suitable fluid to the actuator. The actuator 93 includes an actuator rod 96 projecting upward from the actuator and attached to a drive plate 97. The actuator 93 is capable of extending-retracting and rotating the actuator rod 96, and consequently the drive plate 97, as indicated by the arrows in FIGS. 4 and 5. In one specific embodiment, the multi-motion actuator 93 is produced by phd, Inc. under catalog number 816K.

In the present embodiment, the drive plate 97 also includes a friction surface $97_a$ that is facing the friction surface $89_a$ of the base plate 89. Thus, the frictional contact between the two surfaces $89a$ and $97a$ permit the transmission of rotational motion therebetween. In an alternative embodiment, one of the base plate 89 or drive plate 97 can include a magnetic surface, while the other of the plates is composed of a magnetic material. In this alternative embodiment, the magnetic attraction between the two plates supplants the frictional contact of the preferred embodiment to provide means for transmitting rotation between the two plates.

In order to rotate the rotator plate 80, the actuator 93 is energized to stroke the actuator rod 96 vertically upward until the drive plate 97 contacts the base plate 89. In one specific mode of operation, the actuator rod strokes far enough so that the rotator plate 80 lifts off from the surface of the turntable 70 in order to facilitate rotation of the plate. Once the drive plate has been moved upward to the base plate with the two friction faces $89_a$ and $97_a$ in contact, the actuator 93 strokes so that the actuator rod 96, drive plate 97, base plate 89, and consequently rotator plate 80, all rotate through a specific number of angular degrees. In FIG. 5, the drive plate 97 is shown in its fully actuated orientation with the rotator plate 80 offset from the turntable 70. The rotator plate 80 rotates in the direction of the arrow indicated on the side of the plate 80 in FIG. 5.

Once the rotator plate 80 has been moved through its predetermined angular rotation, the actuator 93 is energized to retract the actuator rod 96 so that the rotator plate 80 is dropped onto the turntable 70 and the drive plate 97 is moved away from the base plate 89. Unlike the rotary actuator 84 for the turntable 70, no one-way clutch is required since the multi-motion actuator 93 is fully disengaged from the rotator plate 80. It should be obvious that this arrangement of multi-motion actuator and drive plate permits the means for rotating the rotator plate 80 to be disconnected from the rotator plate as the turntable 70 is rotated.

Figure 6A:
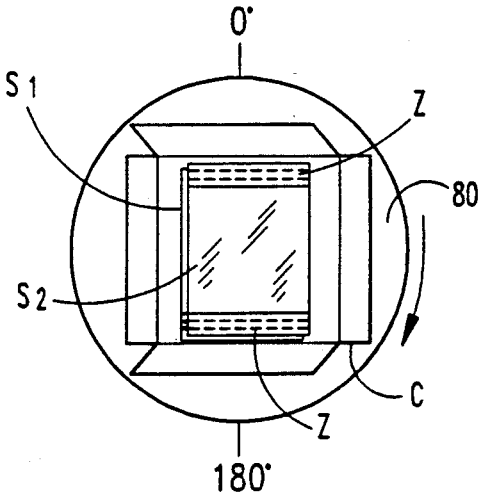
FIG. 6A is a top view of a shipping container on a rotator plate at the stacking station of FIGS. 4 and 5 showing the 180° stacking arrangement of finished bags stacked within the shipping box.
Figure 6B:
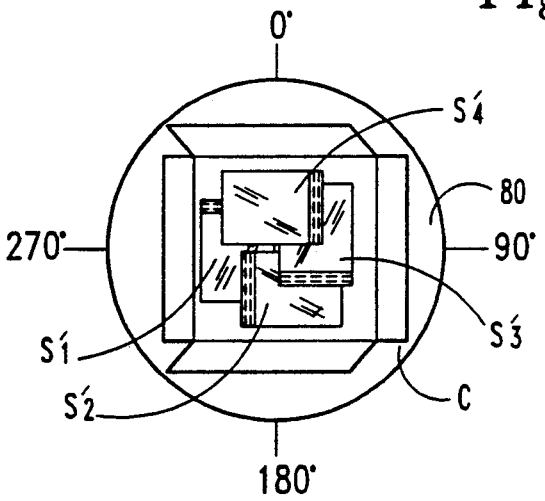
FIG. 6B is a top view of a shipping container on the rotator plate at the stacking station of FIGS. 4 and 5 showing the 90° stacking arrangement for finished bags stacked within the shipping container.
Figure 6C:
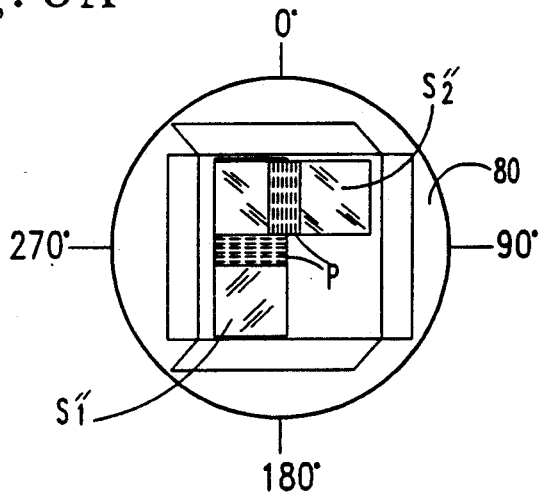
FIG. 6C is a top view of a shipping container on the rotator plate at the stacking station of FIGS. 4 and 5 showing a saddle pack stacking arrangement.

The multi-motion actuator 93 can be calibrated to rotate the rotator plate 80 through a predetermined number of angular degrees. For instance, as shown in FIG. 6A, the plate can be rotated through a full 180° so that the consecutive stacks $S_1$ and $S_2$ can be arranged in alternating opposing orientation. Thus, the zipper Z of each stack will be situated directly adjacent the ends of the bags of the next sequential stack, as shown in the figure. Likewise, the actuator 93 can be calibrated to rotate the rotator plate 80 through 90 degrees so that smaller bags can be arranged in a number of stacks S1'–S4', as shown in FIG. 6B. The present invention can also be adapted for saddle packed bags, as shown in FIG. 6C. Each of the stacks $S''_1$ and $S''_4$ consists of layers of edge connected bags separated by a line of perforations P. It should be apparent that the actuator can be controlled to rotate the rotator plate 80 through any number of degrees, depending upon the dimensions of the bag and the specific alternating orientations desired.

Figure 7:
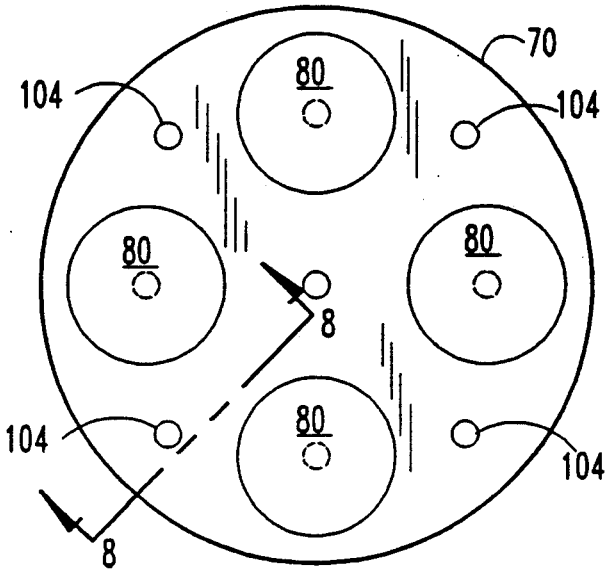
FIG. 7 is a reduced top view of a turntable as shown in FIG. 3 depicting the orientation of locator holes for the stop assembly of one embodiment of the invention.
Figure 8:
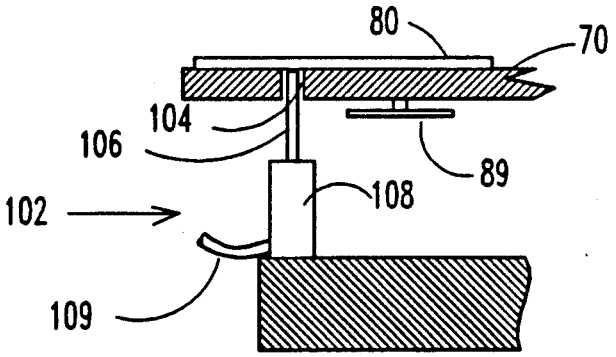
FIG. 8 is a side cross-sectional view taken along line 8—8 in FIG. 7 as viewed in the direction of the arrows showing the stop assembly of one embodiment of the invention.
Figure 9:
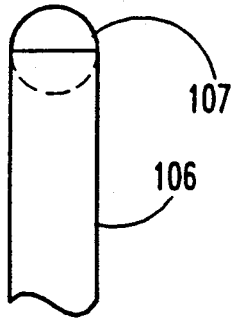
FIG. 9 is an enlarged detail view of the locator pin of the stop assembly shown in FIG. 8.

In one embodiment of the invention, the degree of motion provided by each of the actuators 84 and 93 can be mechanically controlled by calibrating the specific actuator. That is the actuators can be calibrated to move through a specific stroke and then automatically deenergized. In an alternative embodiment, means are provided under the turntable 70 to ensure that the turntable does not overshoot its predetermined degree of motion as the actuator 84 is stroked. Referring to FIGS. 7–9, a stop assembly 102 includes a vertically actuated pin 106 that extends into one of a number of locator holes 104 in the turntable 70. As shown in FIG. 7, locator holes 104 are uniformly disposed between rotator plates 80. When the pin 106 extends through a hole 104 the turntable 70 is prevented from rotating further.

The extension of pin 106 is controlled by a cylinder 108, which in the preferred embodiment is a pneumatic cylinder connected by hose 109 to pneumatic controller 99 (FIG. 4). Encased at the end of pin 106 is a ball bearing guide which contacts the underside of the turntable 70 in rolling engagement. When the turntable is to be rotated by its actuator 84, the controller 99 directs the cylinder 108 to momentarily retract the pin 106. Once the turntable move begins, the cylinder strokes the pin 106 upward until the ball bearing guide 107 contacts and rides on the turntable 70. The cylinder 108 continues to exert a slight upward force on the pin so that once the pin reaches one of the locator holes 104 the pin 106 automatically extends into the hole. Ideally, the action of the controller 99 is precise enough to also stop the rotation of the turntable 70 at the same time that the pin 106 engages the locator hole 104. However, due to inertial effects, the turntable 70 may have a tendency to overshoot its proper angular position. Thus, the stop assembly 102 operates to positively halt the rotation of the turntable 70 at its precise appointed angular position.

In the preferred embodiment, the pneumatic hoses 85, 94 and 109 of the actuators 84, 93 and 108, respectively, are fed to a pneumatic controller 99. The pneumatic controller 99 also engages the pneumatic hoses 52 that control the operation of the right and left doors 44 and 45 of the catch tray assembly 36, and the pneumatic hose 39 of the stack compressor 38. The pneumatic controller 99 provides means for controlling the supply of pressurized fluid, such as compressed air, through each of the pneumatic hoses to the corresponding components.

Figure 10:
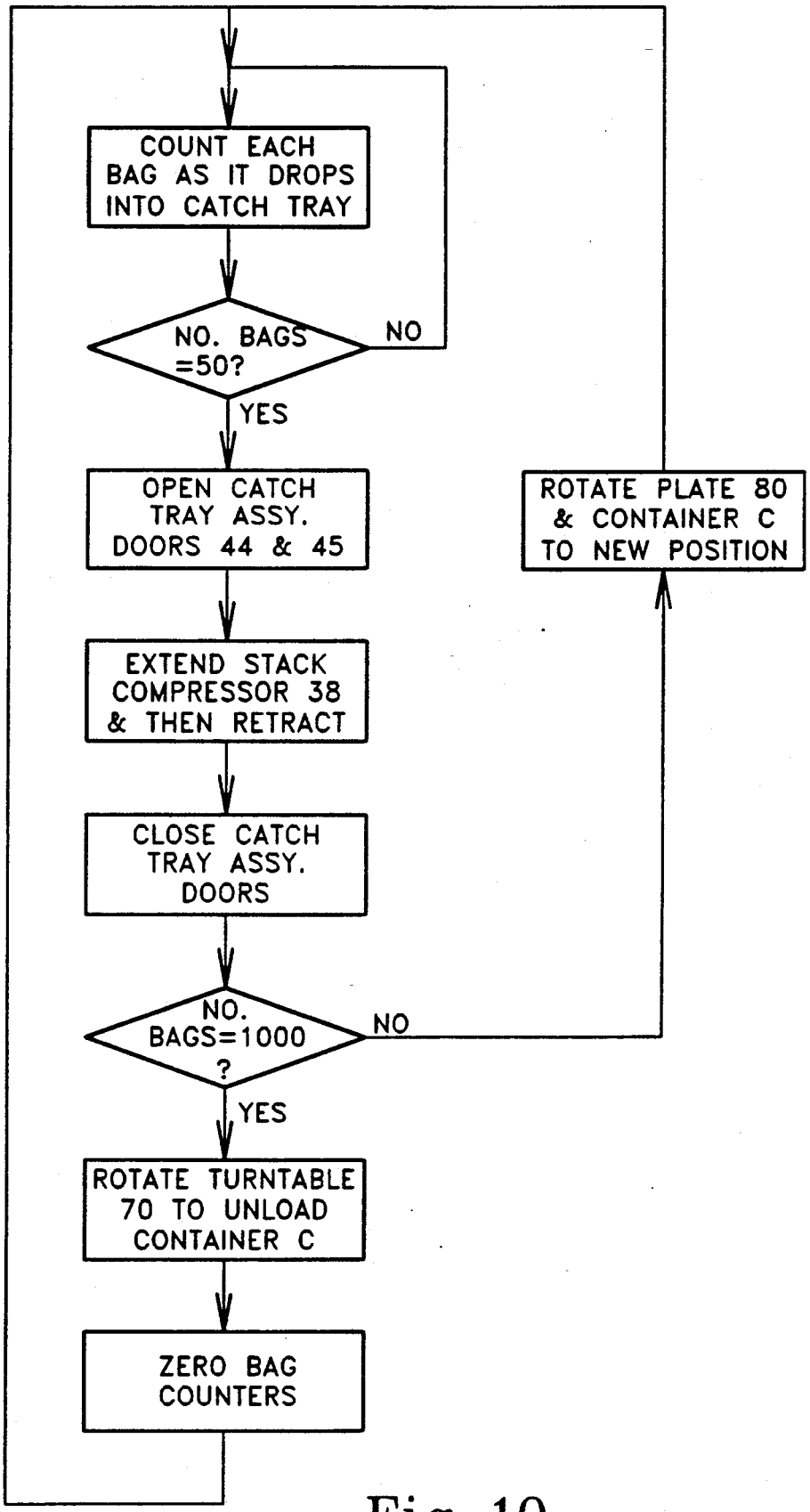
FIG. 10 is a flowchart of the steps implemented by the programmable controller of the preferred embodiment of the packaging assembly shown in FIG. 4 to package finished bags within a shipping container.

The pneumatic controller 99 is itself controlled by a programmable controller 100. The programmable controller 100 can also receive a signal from counter 68 which permits counting of the number of bags being fed to the stacking station 41 and packed in containers C, by way of internal counters of the controller. The programmable controller can be programmed to provide a specific timed sequence of operation of each of the controlled components of the packaging assembly 40. For instance, a program implemented by the controller 100 can cause the compressor 38 to stroke and then retract as each bag B falls into the catch tray assembly 36, the catch tray assembly doors 44 and 45 to open, and the doors 44 and 45 to close after stack S of bags has fallen into the container C. The program can then sequentially rotate the container C at the stacking station 41, unless it is determined that the container C is filled with the predetermined requisite number of bags, in which case the turntable 70 can be rotated to move the container C to the unloading conveyor 76. The internal counters of the controller corresponding to the number of bags being loaded in the containers can then be zeroed. On the other hand, if the container is not yet full, the controller 100 can direct the multi-motion actuator 93 to extend and rotate the plate 80 and thereby rotate the container C to a new position awaiting a new stack of bags S. This general mode of sequential operation is depicted in the flow chart shown at FIG. 10. Variations in this sequence that may occur to one of ordinary skill in the art are contemplated by this invention.

In one specific embodiment, the programmable controller is produced by Modicon, Inc., Industrial Automation Systems. The controller is the Modicon PC0085, which includes a number of integral timers and counters that can be connected to a number of input and output modules. The Modicon PC0085 is programmable to implement conventional relay board ladder charting techniques. A listing of a program executed by the Modicon PC0085 controller to implement the above operation sequence in one specific embodiment of the invention is shown in FIGS. 11A–11B.

Although the embodiments of the invention thus far described have been for use in single bag manufacturing systems, the invention may be adapted for use in double bag or edge connected bag manufacturing systems. Such a system is described in U.S. Pat. No. 4,787,755 to the same inventor. The double bag manufacturing system is more particularly described at columns 7–9 and shown in FIG. 4 of that patent, which description is incorporated herein by reference. It is understood, however, that the system of the '755 patent is referred for illustrative purposes only, and it is further understood that present invention can be used with other double bag manufacturing systems.

Figure 12:
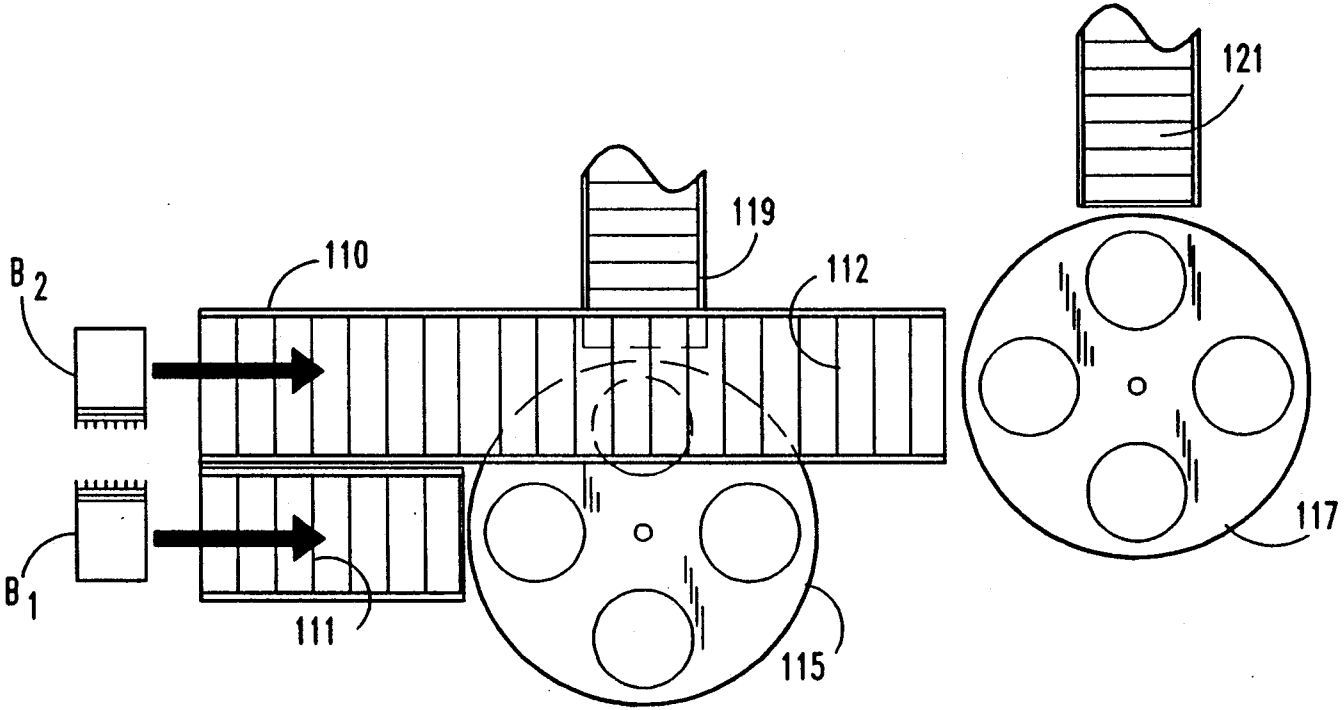
FIG. 12 is a reduced top schematic view of an alternative embodiment of the invention for use in connection with a bag manufacturing apparatus for separated edge connected bags.

As described in the '755 patent, a double bag system produces a pair of edge connected bags from a single extruded tube. A line of perforations separate the two bags at the connected edge. The embodiment of the present invention is adapted for packaging the individual bags after they have been separated at the perforation edge. Thus, as shown in FIG. 12, a pair of separated bags $B_1$ and $B_2$, which have been produced using the system of the '755 patent, are fed to a conveyor apparatus 110, which in most respects is similar to the conveyor apparatus 32 of the previous embodiments. In a deviation from the prior apparatus, the conveyor apparatus 110 is wide enough to accept two rows of bags. The apparatus 110 includes two parallel sections 111 and 112 along which bags $B_1$ and $B_2$, respectively, are transported. At the end of each conveyor section 111 and 112 is a corresponding bag packaging assembly 115 and 117. Each packaging assembly 115 and 117 is identical to the packaging assembly 40 described above (although the catch tray assembly 36 has not been depicted in FIG. 12 for clarity). A pair of parallel unloading conveyors 119 and 121 withdraw filled containers from its corresponding packaging assembly.

It is apparent that the embodiment schematically illustrated in FIG. 12 includes all the features of and operates in all respects similar to the prior embodiments. It is further apparent that the same programmable controller 100 (FIG. 4) can be adapted to control the components of the two packaging assemblies 115 and 117 in a time coordinated manner.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

For example, while only zippered bags have been discussed with respect to the preferred embodiments, it is clear that the present invention can also be used with flat bags (that is, bags without any reclosable fastener at the mouth of the bag). With flat bags, the concerns over the arrangement of successive stacks of bags are not as great. The bag counting aspects implemented by the controller 100 of this invention can be applied to automatically pack a predetermined number of bags in a shipping container.

What is claimed is:

1. A system for the continuous manufacture and packaging of flexible bags comprising:

means for continuously manufacturing separate bags;

a conveyor for receiving the separate bags from said means for continuously manufacturing and for conveying the separate bags to a stacking station beyond an end of said conveyor;

means for supporting an open container at said stacking station whereby the separate bags conveyed beyond said end of said conveyor drop into the open container; and means for conveying the open container away from said stacking station to an unloading station when the open container contains a predetermined first number of the separate bags;

wherein said means for supporting an open container includes;

a support plate; and means for rotating said support plate through about ninety angular degrees (90°) after a second number of separate bags has been dropped into the open container, whereby the open container rotates with said support plate such that bags are stacked within the open container in alternating orientations.

2. The system for the continuous manufacture and packaging of flexible bags of claim 1 further comprising:

means for receiving and stacking the separate bags in an openable and closable catch tray at said stacking station; and means for opening said catch tray to drop the separate bags into the open container at said stacking station when a third number of bags is stacked in said tray.

3. The system for the continuous manufacture and packaging of flexible bags of claim 2, further comprising:

a stack compressor situated at said stacking station and including;

a foot; and means for retractably extending said foot into said catch tray at said stacking station to compress the separate bags stacked therein.

4. The system for the continuous manufacture and packaging of flexible bags of claim 3, further comprising:

means for controlling the operation of said means for extending said foot to extend said foot as each separate bag drops into said catch tray.

5. An assembly for continuously packaging flexible bags comprising:

means for supporting an open container at a stacking station for collecting flexible bags to be packaged in the open container;

means at said stacking station for rotating the open container through a predetermined number of angular degrees after a stack including a first number of bags has been collected in the open container, whereby successive stacks containing said first number of bags are arranged within the open container in alternating orientations;

means for conveying the open container away from said stacking station to an unloading station when the open container contains a second number of the bags;

an openable and closable catch tray for receiving and collecting the flexible bags; and means for opening said catch tray to drop the bags into the open container at said stacking station when a third number of bags is stacked in said catch tray.

6. The system for packaging flexible bags of claim 5, further comprising: a stack compressor situated at said stacking station and including;

a foot; and means for extending said foot into said catch tray to compress the bags collected therein.

7. The assembly for continuously packaging flexible bags of claim 6, further comprising:

a programmable controller having means for automatically controlling the sequential operation of said stack compressor, said catch tray, said means for rotating the open container and said means for conveying the open container.

8. An assembly for continuously packaging flexible bags comprising:

means for supporting an open container at a stacking station for collecting flexible bags to be packaged in the open container;

means at said stacking station for rotating the open container through a predetermined number of angular degrees after a stack including a first number of bags has been collected in the open container, whereby successive stacks containing said first number of bags are arranged within the open container in alternating orientations;

means for conveying the open container away from said stacking station to an unloading station when the open container contains a second number of the bags; and a programmable controller having means for automatically controlling the sequential operation of said means for rotating the open container and said means for conveying the open container.

9. A system for the continuous manufacture and packaging of flexible bags comprising:

means for continuously manufacturing separate bags;

a conveyor for receiving the separate bags from said means for continuously manufacturing and for conveying the separate bags to a stacking station beyond an end of said conveyor;

means for supporting an open container at said stacking station whereby the separate bags conveyed beyond said end of said conveyor drop into the open container; and means for conveying the open container away from said stacking station to an unloading station when the open container contains a predetermined first number of the separate bags, wherein said means for conveying the open container includes;

a turntable having means for carrying said means for supporting an open container;

means for rotating said turntable through a predetermined number of angular degrees to an unloading station;

an unloading conveyor intersecting said turntable; and means for opening said catch tray to drop the separate bags into the open container at said stacking station when a third number of bags is stacked in said tray.

10. The system for the continuous manufacture and packaging of flexible bags of claim 9, wherein said predetermined number of angular degrees is at least 90°.

11. The system for the continuous manufacture and packaging of flexible bags of claim 9, further comprising:

a feed conveyor intersecting said turntable for feeding a new open container onto said turntable.

12. The system for the continuous manufacture and packaging of flexible bags of claim 11, wherein said feed conveyor intersects said turntable at said predetermined number of degrees from said stacking station opposite said unloading station.

13. A system for the continuous manufacture and packaging of flexible bags comprising:

means for continuously manufacturing separate bags;

a conveyor for receiving the separate bags from said means for continuously manufacturing and for conveying the separate bags to a stacking station beyond an end of said conveyor;

means for supporting an open container at said stacking station whereby the separate bags conveyed beyond said end of said conveyor drop into the open container; and means for conveying the open container away from said stacking station to an unloading station when the open container contains a predetermined first number of the separate bags, wherein, said means for conveying the open container includes;

a turntable;

means for rotating said turntable through a first predetermined number of angular degrees to an unloading station; and said means for supporting an open container includes:

a number of support plates;

means for rotatably supporting each of said number of support plates on said turntable;

means at said stacking station for rotating one of said number of support plates through a predetermined second number of angular degrees after a second number of separate bags has been dropped into the open container, whereby the open container rotates with said one of said number of support plates such that bags are stacked within the open container in alternating opposing orientations.

14. The system for the continuous manufacturing and packaging of flexible bags of claim 13, wherein:

said means for supporting an open container includes a plurality of support plates supported on said turntable at angular intervals equal to said first predetermined number of angular degrees.

15. The system for the continuous manufacture and packaging of flexible bags of claim 13, wherein:

said means for rotatably supporting each of said number of support plates on said turntable includes;

a bore through said turntable; and a spindle affixed at one end to said support plate to project from said support plate and extending through said bore; and said means for rotating one of said number of support plates includes;

a base plate affixed at the other end of said spindle, said base plate having a first friction surface;

an actuator having an actuator rod and means for extending and rotating said actuator rod; and a drive plate affixed at one end of said actuator rod, said drive plate having a second friction surface, whereby said actuator rod is extendable to move said drive plate into contact with said base plate, and further whereby said actuator rod is rotatable to rotate said drive plate, thereby rotating said base plate when said first and second friction surfaces are in contact.

16. An assembly for continuously packaging flexible bags comprising:

means for supporting an open container at a stacking station for collecting flexible bags to be packaged in the open container;

means at said stacking station for rotating the open container through a predetermined number of angular degrees after a stack including a first number of bags has been collected in the open container, whereby successive stacks containing said first number of bags are arranged within the open container in alternating orientations; and means for conveying the open container away from said stacking station to an unloading station when the open container contains a second number of the bags, wherein;

said means for supporting an open container includes a support plate rotatably mounted on a support surface wherein the open container is situated on said support plate;

said means for rotating the open container includes a rotary actuator and means for rotatably coupling said actuator to said support plate to rotate said support plate; and said means for conveying the open container includes means for moving said support plate away from said stacking station to said unloading station.

17. The assembly for continuously packaging flexible bags of claim 16, wherein:

said support surface is a turntable having means for rotatably supporting said support plate thereon; and said means for moving said support plate includes means for rotating said turntable.

18. The assembly for continuously packaging flexible bags of claim 16, wherein said means for rotatably coupling said actuator to said support plate includes:

a spindle affixed at one end to said support plate to project from said support plate;

a base plate affixed at the other end of said spindle;

said rotary actuator having an actuator rod and means for extending and rotating said actuator rod;

a drive plate affixed at one end of said actuator rod; and means for releasably transmitting rotational motion between said drive plate to said base plate when said drive plate is adjacent said base plate;

whereby said actuator rod is extendable to move said drive plate adjacent said base plate, and further whereby said actuator rod is rotatable to rotate said drive plate, thereby rotating said base plate through said means for releasably transmitting rotational motion.

19. The assembly for continuously packaging flexible bags of claim 18, wherein said means for releasably transmitting rotational motion includes friction contact surfaces on said base plate and said drive plate.

20. The assembly for continuously packaging flexible bags of claim 18, wherein said means for releasably transmitting rotational motion includes magnetically engagable surfaces on said base plate and said drive plate.

21. A system for the continuous manufacture and packaging of flexible bags comprising:

means for continuously manufacturing separate bags;

a conveyor for receiving the separate bags from said means for continuously manufacturing and for conveying the separate bags to a stacking station beyond an end of said conveyor;

means for supporting an open container at said stacking station whereby the separate bags conveyed beyond said end of said conveyor drop into the open container; and means for conveying the open container away from said stacking station to an unloading station when the open container contains a predetermined number of the separate bags;

wherein said means for continuously manufacturing includes:

an extruder for extruding a continuous sheet of film;

means for providing interlocking zipper profiles on the continuous sheet of film; and means for the forming separate bags from the continuous sheet including;

means for continuously drawing the sheet from said extruder with the interlocking zipper profiles oriented in opposing relation;

an edge sealer for intermittently sealing the sheet to form sealed bag edges; and means for cutting the sheet at the sealed bag edges to form the separate bags.

22. A system for the continuous manufacture and packaging of flexible bags comprising:

means for continuously manufacturing separate bags;

a conveyor for receiving the separate bags from said means for continuously manufacturing and for conveying the separate bags to a stacking station beyond an end of said conveyor;

means for supporting an open container at said stacking station whereby the separate bags conveyed beyond said end of said conveyor drop into the open container; and means for conveying the open container away from said stacking station to an unloading station when the open container contains a predetermined first number of the separate bags;

wherein said means for continuously manufacturing includes;

means for manufacturing edge connected pairs of bags; and means for separating said connected pairs of bags;

said conveyor includes a pair of conveyor portions, one each of said conveyor portions for conveying one each of said separated pairs of bags to one of a pair of stacking stations;

said means for supporting an open container includes a pair of means for supporting an open container, one each at a corresponding one of said stacking stations; and said means for conveying the open container includes a pair of means for conveying the open container, one each at a corresponding one of said stacking stations.

23. The system for the continuous manufacture and packaging of flexible bags of claim 22, wherein each of said pair of means for supporting an open container includes:

a support plate;

means for rotating said support plate through a predetermined first number of angular degrees after a second number of separate bags has been dropped into the open container, whereby the open container rotates with said support plate such that bags are stacked within the open container in alternating orientations.

24. The system for the continuous manufacture and packaging of flexible bags of claim 22, wherein each of said pair of means for conveying the open container includes:

a turntable having means for carrying said means for supporting an open container;

means for rotating said turntable through a second predetermined number of angular degrees to an unloading station;

an unloading conveyor intersecting said turntable; and an arm situated at said unloading station for directing the open container from said turntable surface onto said unloading conveyor.

25. An assembly for continuously packaging flexible bags comprising:

means for supporting an open container at a stacking station for collecting flexible bags to be packaged in the open container;

means at said stacking station for rotating the open container through a predetermined first number of angular degrees after a stack including a first number of bags has been collected in the open container, whereby successive stacks containing said first number of bags are arranged within the open container in alternating orientations; and means for conveying the open container away from said stacking station to an unloading station when the open container contains a second number of the bags, wherein said means for conveying the open container includes;

a turntable having means for carrying said means for supporting an open container;

means for rotating said turntable through a second predetermined number of angular degrees to an unloading station.

26. The system for continuously packaging flexible bags of claim 25, wherein said second predetermined number of angular degrees is at least 90°.

27. The system for continuously packaging flexible bags of claim 25, wherein said means for conveying the open container further includes:

an unloading conveyor intersecting said turntable; and an arm situated at said unloading station for directing the open container from said turntable surface onto said unloading conveyor.

28. The system for continuously packaging flexible bags of claim 25, wherein said means for supporting an open container includes a plurality of support plates carried on said turntable at angular intervals equal to said second predetermined number of angular degrees.

29. The system for continuously packaging flexible bags of claim 25, further comprising:

a feed conveyor intersecting said turntable for feeding a new open container onto said turntable.

30. The system for continuously packaging flexible bags of claim 29, wherein said feed conveyor intersects said turntable at said second predetermined number of degrees from said stacking station.

31. The assembly for continuously packaging flexible bags of claim 25, wherein said means for rotating said turntable includes stop means for stopping the rotation of said turntable, said stop means including:

a number of locator holes in said turntable;

a stop pin; and means for extending said stop pin into one of said number of locator holes after said turntable has rotated through a predetermined number of angular degrees.

32. The assembly for continuously packaging flexible bags of claim 31, wherein:

said stop pin includes a bearing surface; and said means for retractably extending said stop pin includes means for resiliently urging said bearing surface of said stop pin into bearing contact with said turntable as said turntable rotates, whereby said stop pin is resiliently urged by said means for extending into said one of said locator holes when said one of said locator holes is aligned with said stop pin by rotation of said turntable.

33. The assembly for continuously packaging flexible bags of claim 32, wherein said means for retractably extending said stop pin includes a fluid cylinder.

34. An assembly for continuously packaging flexible bags comprising:

means for supporting an open container at a stacking station for collecting flexible bags to be packaged in the open container;

means at said stacking station for rotating the open container through about ninety angular degrees (90°) after a stack including a first number of bags has been collected in the open container, whereby successive stacks containing said first number of bags are arranged within the open container in alternating orientations; and means for conveying the open container away from said stacking station to an unloading station when the open container contains a second number of the bags.

* * * * *